US009345291B2

(12) United States Patent
Brenner

(10) Patent No.: US 9,345,291 B2
(45) Date of Patent: May 24, 2016

(54) ARTICLE CARRIER

(71) Applicant: Katherine C. Brenner, New York, NY (US)

(72) Inventor: Katherine C. Brenner, New York, NY (US)

( * ) Notice: Subject to any disclaimer, the term of this patent is extended or adjusted under 35 U.S.C. 154(b) by 62 days.

(21) Appl. No.: 14/506,367

(22) Filed: Oct. 3, 2014

(65) Prior Publication Data

US 2015/0097010 A1 Apr. 9, 2015

Related U.S. Application Data

(60) Provisional application No. 61/887,291, filed on Oct. 4, 2013.

(51) Int. Cl.

| | |
|---|---|
| ***A45F 5/00*** | (2006.01) |
| ***A44C 5/00*** | (2006.01) |
| *A45F 5/10* | (2006.01) |

(52) U.S. Cl.

CPC ..... *A44C 5/0007* (2013.01); *A45F 5/00* (2013.01); *A45F 5/1026* (2013.01); *A45F 2005/008* (2013.01)

(58) Field of Classification Search

CPC ..... A45F 2005/008; A45F 2005/1033; A45F 2005/1046; A45F 5/1026

USPC ..... 224/222, 267, 255, 268, 925, 907

See application file for complete search history.

(56) References Cited

U.S. PATENT DOCUMENTS

| | | | | |
|---|---|---|---|---|
| 452,830 | A | | 5/1891 | Bowie et al. |
| 1,279,073 | A | | 9/1918 | Baake |
| 1,463,977 | A | | 8/1923 | Smith |
| 1,557,271 | A | * | 10/1925 | Rittenhouse, Jr. ..... A45C 13/38 224/267 |
| 1,643,106 | A | | 9/1927 | Williams |
| 2,449,882 | A | * | 9/1948 | Daniels ..... A61M 25/02 128/DIG. 26 |
| 3,809,349 | A | | 5/1974 | Baedke |
| 4,243,249 | A | * | 1/1981 | Goss ..... B42F 9/001 108/43 |
| D260,620 | S | | 9/1981 | Blum |
| 4,896,465 | A | * | 1/1990 | Rhodes ..... A61M 5/1418 128/849 |
| D351,933 | S | * | 11/1994 | Stoneman ..... 2/160 |
| D382,829 | S | | 8/1997 | Hoffman |
| 5,894,972 | A | | 4/1999 | Brown |
| 5,901,930 | A | * | 5/1999 | Harrel ..... F16L 3/01 224/222 |
| 5,904,388 | A | * | 5/1999 | Seibel ..... A45C 13/28 294/141 |
| 5,961,066 | A | * | 10/1999 | Hambleton ..... B65H 35/0026 224/162 |
| 6,038,743 | A | | 3/2000 | Chapman |
| 6,053,169 | A | | 4/2000 | Hunt |

(Continued)

*Primary Examiner* — Justin Larson

(74) *Attorney, Agent, or Firm* — Richard C. Litman

(57) ABSTRACT

The article carrier includes a removable wristband having a normally closed clasp installed along one side thereof. The wristband is secured about the lower forearm and wrist of the user immediately above the hand, and may be secured using any of a number of different fastener configurations. The clasp is pivotally attached to the wristband by a lateral pin, and a coil spring is installed on the pin to bias the clasp to a normally closed position. A mechanical latch may be installed to provide positive closure for the clasp. The clasp has a width and length substantially equal to the diameter and length of the wristband.

20 Claims, 3 Drawing Sheets

(56) References Cited

U.S. PATENT DOCUMENTS

| | | | | |
|---|---|---|---|---|
| 6,095,093 | A | 8/2000 | Kisko et al. | |
| 6,113,565 | A | 9/2000 | Schlup et al. | |
| 6,467,132 | B1 | 10/2002 | Robley | |
| 6,696,986 | B1 | 2/2004 | Harrison, Jr. et al. | |
| 6,824,182 | B2 | 11/2004 | Graham | |
| 7,020,935 | B2 | 4/2006 | Behn et al. | |
| 7,387,324 | B1 | 6/2008 | Sharpe | |
| 8,851,342 | B2 * | 10/2014 | Carbone | A47D 13/02 224/158 |
| 2004/0084489 | A1 * | 5/2004 | Murphey | A45F 5/00 224/221 |
| 2009/0199939 | A1 | 8/2009 | Pruzhansky | |
| 2009/0294495 | A1 | 12/2009 | Moreau et al. | |
| 2011/0215120 | A1 | 9/2011 | Blake | |
| 2012/0312851 | A1 | 12/2012 | Rico | |
| 2013/0020359 | A1 | 1/2013 | Green | |

* cited by examiner

ARTICLE CARRIER

CROSS-REFERENCE TO RELATED APPLICATION

This application claims the benefit of U.S. Provisional Patent Application Ser. No. 61/887,291, filed Oct. 4, 2013.

BACKGROUND OF THE INVENTION

1. Field of the Invention

The present invention relates generally to brackets, holders, and the like for the support and/or carriage of various articles, and more particularly, to an article carrier that is worn on the lower forearm and/or wrist for the hands-free carriage of shopping bags and the like.

2. Description of the Related Art

It is customary and well known for persons to carry various articles, packages, etc., in their hands to convey those goods from place to place. Obviously, this precludes the use of the hands for other purposes, such as manipulating keys, door latches and knobs, light switches, etc. Moreover, the human hand is composed of relatively small and weak muscles and other tissues, in comparison to the arms and legs. Accordingly, those muscles that undergo the greatest strain and which tire most rapidly when carrying a heavy object are those of the fingers and hands. The larger arm muscles are relatively unstressed during such activity. Although many shopping bags or tote bags have straps, the straps tend to bite into the hands and fingers when the articles being carried are heavy or are carried for a long time, and may similarly bite into the forearm or slide uncomfortably on the forearm when the straps are looped over the forearm, requiring use of the hands to adjust the bags.

Accordingly, a number of devices have been developed in the past to ease the burden of carrying an object. These devices range from backpacks and knapsacks to belts having means for the carriage of various articles, and further, to simple machines, such as carts and the like. While these devices serve their purpose, they are for the most part relatively large and cumbersome for the carriage of such smaller articles as a grocery bag or shopping bag that may weigh only a few pounds when fully loaded.

Thus, an article carrier solving the aforementioned problems is desired.

SUMMARY OF THE INVENTION

The article carrier comprises a wide wristband that secures removably about the wrist and lower forearm immediately above the hand. The wristband is preferably formed of a reasonably stiff yet slightly flexible material, such as a heavy nylon canvas or cotton duck material, or even leather. The material is preferably lined with soft cotton or other fabric for comfort. A number of different closures may be used to secure the device about the lower forearm and/or wrist of the user, e.g., zipper, snaps, buttons, mating hook and loop fabric material (e.g., Velcro®), etc.

A rigid clasp is installed upon the wristband, or more specifically, upon a base that is incorporated into the wristband. The wristband material extends over the base to provide an attractive appearance for the device. The base has an underside that conforms to the shape of the wrist or lower forearm when placed thereon, and a flat upper surface to accommodate the lateral hinge pin of the clasp. The clasp is hinged to the base at the distal end of the device, i.e., the end adjacent the hand when the device is being worn. A spring urges the clasp to a normally closed position. The opposite, openable end of the clasp is lifted to allow bag handles, straps and the like to be placed between the clasp and the underlying base. The openable end of the clasp may be positively closed by a mechanical latch.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
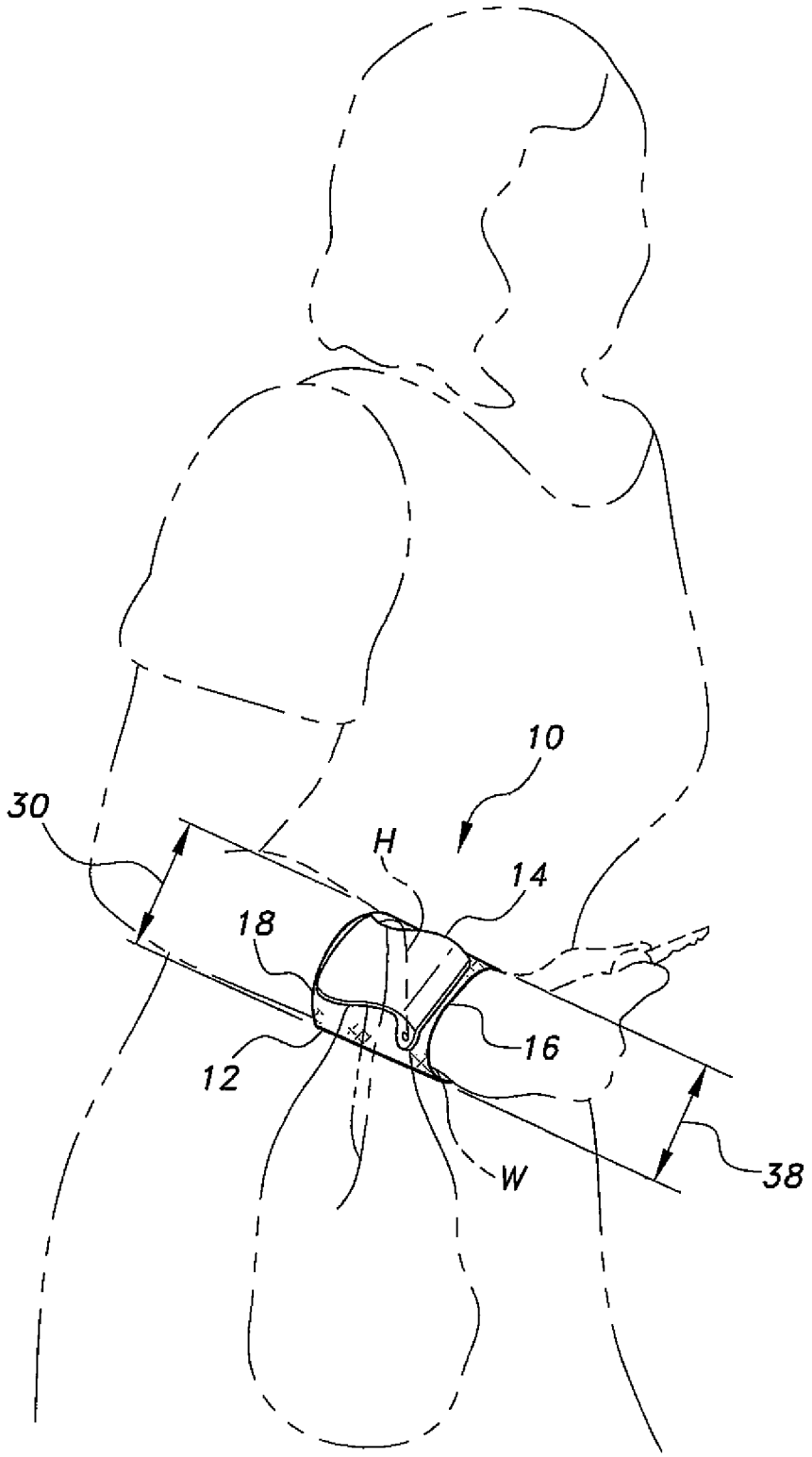
FIG. 1 is an environmental, perspective view of a first embodiment of an article carrier according to the present invention, showing hands-free suspension of a shopping bag from the forearm.
Figure 2:
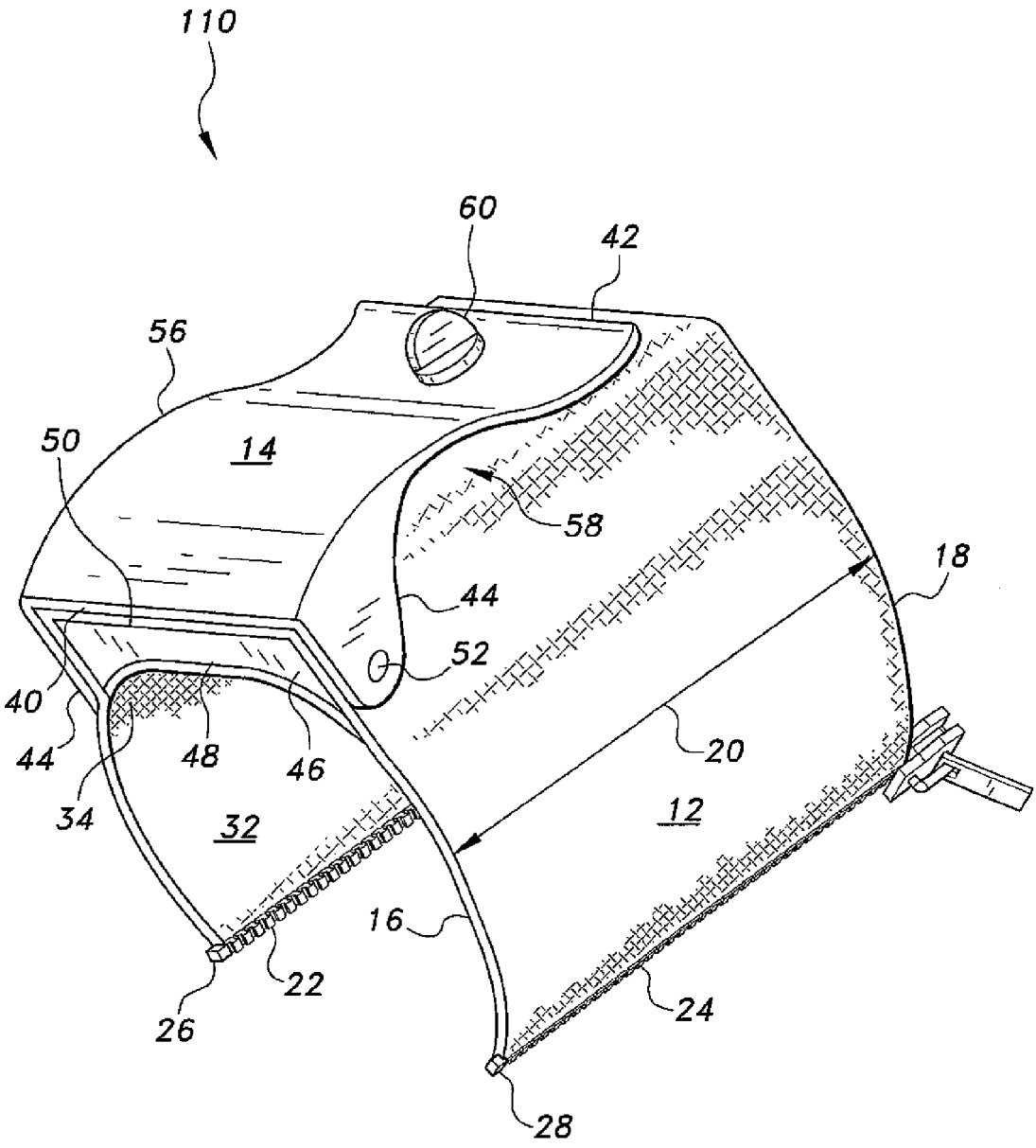
FIG. 2 is a detailed perspective view of a second embodiment of the article carrier according to the present invention, illustrating various features thereof.
Figure 3:
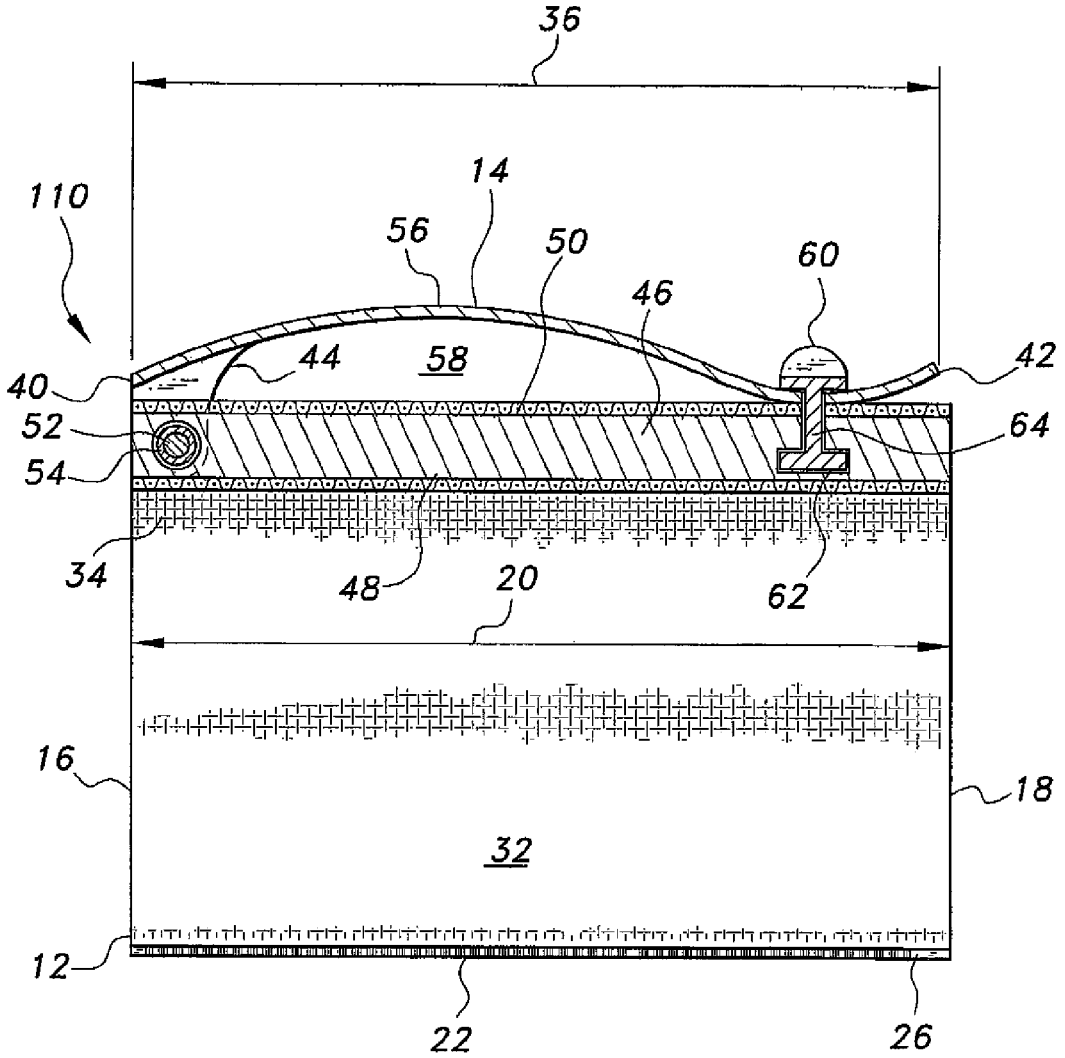
FIG. 3 is a side elevation view in section of the second embodiment of the article carrier according to the present invention, illustrating further features thereof.

The article carrier includes a first embodiment 10 as shown generally in FIG. 1, and a second embodiment 110 as shown in further detail in FIGS. 2 and 3. The embodiment 110 of FIGS. 2 and 3 includes a mechanical latch to positively secure the openable end of the clasp in a closed position, while the first embodiment 10 does not include such a latch. Otherwise, identical components of the two embodiments share identical reference numerals for those components.

FIG. 1 of the drawings provides an environmental perspective view of the first embodiment article carrier 10 as it would be worn upon the lower arm or wrist W of a user of the device. The article carrier 10 generally includes a wristband 12 formed of a thin, semi-rigid sheet of material, such as canvas or duck fabric formed of either natural or synthetic fiber(s), woven plastic fiber or nonwoven plastic sheet material (e.g., Nylon®, etc.), or leather. A clasp 14 that is formed of a rigid material (e.g., metal, a strong, rigid plastic, etc.) is pivotally attached to the wristband 12. One end of the clasp 14 is capable of being lifted or pivoted away from the wristband 12 to allow the insertion of a bag strap or handle H between the clasp 14 and underlying wristband 12.

FIGS. 2 and 3 provide detailed views of a second embodiment of the article carrier, designated as article carrier 110 due to the addition of a latch thereto. Otherwise, the article carrier 110 is identical to the article carrier 10 of FIG. 1. The wristband 12 of the article carriers 10 and 110 has a distal end 16, i.e., the end closer to the hand and farther from the elbow of the person wearing the device, and an opposite proximal end 18. The two ends 16 and 18 define a wristband length 20 therebetween. The wristband 12 further includes a first closure edge 22 and a second closure edge 24. The two closure edges define an axially aligned opening when they are separated to allow the wristband to be applied to the lower forearm and/or wrist W of the user. First and second fasteners 26 and 28 are attached or installed along the respective first and second closure edges 22 and 24 to secure the edges together when desired. The fasteners 26 and 28 may comprise mating zipper teeth, as shown in FIGS. 2 and 3, or other conventional fasteners, such as snaps, buttons, buckles, and hook and loop fabric material, e.g., Velcro®. When the wristband 12 is closed about the lower forearm or wrist W, as shown in FIG. 1, the wristband 12 defines a diameter 30. The inner surface 32 of the wristband 12 is preferably lined with a soft and pliable liner material 34, such as a soft cotton flannel or other suitable material for comfort, generally as indicated in FIGS. 2 and 3 of the drawings.

The selectively openable clasp 14 is installed atop the wristband 12, i.e., generally opposite the closure edges 22 and 24. The clasp 14 preferably has a length 36 that is substantially equal to the length 20 of the wristband 12, as shown in FIG. 3, and a width 38 that is substantially equal to the closed diameter 30 of the wristband 12, as shown in FIG. 1. In this manner, the clasp 14 essentially conceals the underlying wristband 12 and clasp attachment structure to provide a decorative appearance for the article carrier 10 or 110.

The clasp 14 has a distal attachment end 40 permanently affixed to the distal end 16 of the wristband 12 and an opposite selectively openable end 42 adjacent the proximal end 18 of the wristband, as shown in FIGS. 2 and 3. The distal attachment end 40 of the clasp 14 has two opposed ears or lugs 44 that are permanently secured to a clasp attachment base 46, the base 46 comprising a rigid block of material (e.g., wood, plastic, aluminum, etc.) that is, in turn, permanently secured to the wristband 12. The attachment base 46 has a laterally concave undersurface 48 that at least generally conforms to the contour of the human wrist or lower forearm, and a flat upper surface 50. The material of which the wristband 12 is formed preferably extends over the outer surface of the clasp attachment base 46, as shown particularly in FIG. 2, in order to present a more attractive and uniform appearance for the article carriers 10 and 110. A hinge pin 52 passes laterally through the two ears or lugs 44 of the clasp 12 and through the attachment base 46 adjacent the distal end 16 of the wristband 12 to secure the clasp 14 permanently to the wristband 12. A coil or torsion spring 54 is installed concentrically about the hinge pin 52. The spring 54 is installed to bias the clasp 14 to urge the openable end or end portion 42 of the clasp against the underlying wristband surface, i.e., to hold the end portion 42 in normally closed contact with the wristband surface.

The clasp 14 has a raised medial portion 56 between its attachment end 40 and its opposite selectively openable end 42. The raised medial portion 56 is clear of the underlying surface of the wristband 12 to provide a lateral passage 58 thereacross for the carrying straps and handles of grocery bags and other articles. The selectively openable end 42 of the clasp 14 is turned up to clear the underlying surface of the wristband 12 in order to facilitate grasping the openable end 42 to lift it clear of the underlying wristband.

The upturned end portion of the clasp 14, including the contact area thereof between the raised medial portion 54 and the upturned end 42, may include a mechanical latch 60 installed therethrough, as shown in the second embodiment 110 of FIGS. 2 and 3. The latch 60 may comprise a horizontal member 62 at the distal end of a stem 64. The horizontal member 62 passes through a similarly shaped slot in the clasp attachment base 46. A circular volume is provided beneath the slot, enabling the horizontal member 62 of the latch 60 to be rotated such that it is misaligned with the slot of the clasp attachment base 46 and captured therein to hold the clasp 14 positively closed. Alternatively, other conventional latch mechanisms may be provided.

The article carriers 10 and 110 are used generally as shown by the illustration of FIG. 1. The article carriers enable the user to conveniently support various articles having some form of carrying handles or straps thereon, e.g., grocery bags and shopping bags, purses, etc., as desired, without undue strain on the hands and fingers. This also provides the user with a free hand that would otherwise be occupied in the carriage of the articles, enabling the user to access a car key, door key, or other device as needed without need to set down the articles being carried. The utility of the article carrier in its various embodiments will thus be much appreciated by anyone who has occasion to carry one or more articles while simultaneously needing a free hand for other activities or purposes.

It is to be understood that the present invention is not limited to the embodiments described above, but encompasses any and all embodiments within the scope of the following claims.

I claim:

1. An article carrier, comprising:

a wristband formed of a thin, semi-rigid sheet of material, the wristband having a distal end, defined by an edge distal from a user's elbow when the wristband is worn by a user, and a proximal end, defined by an edge proximal to the user's elbow when the wristband is worn by a user, opposite the distal end defining a length therebetween, a first closure edge, and a second closure edge opposite the first closure edge, the wristband defining a diameter when the two closure edges are joined;

mating first and second fasteners disposed along the respective first and second closure edges; and a clasp having an attachment end permanently affixed to the wristband adjacent the distal end thereof and a selectively openable end adjacent the proximal end thereof, the selectively openable end of the clasp being normally closed against the wristband, the clasp having a length substantially equal to the length of the wristband and a width substantially equal to the diameter of the wristband.

2. The article carrier according to claim 1, further comprising:

a clasp attachment base, the base being a rigid block of material having a laterally concave undersurface generally adapted for conforming to the contour of the user's lower forearm and wrist, and a flat upper surface;

a hinge pin disposed laterally through the clasp attachment base adjacent the distal end of the wristband, the attachment end of the clasp being pivotally attached to the hinge pin; and a coil spring disposed concentrically about the hinge pin, the coil spring urging the clasp to a closed position against the wristband.

3. The article carrier according to claim 1, wherein the wristband has an inner surface, the article carrier further comprising a liner disposed upon the inner surface of the wristband, the liner being formed of a sheet of soft and pliable material.

4. The article carrier according to claim 1, wherein the selectively openable end of the clasp has an upturned distal tip clear of the wristband, the clasp further having a raised medial portion clear of the wristband.

5. The article carrier according to claim 1 further comprising a mechanical latch disposed through the selectively openable end of the clasp, the latch selectively securing the selectively openable end of the clasp to the wristband.

6. The article carrier according to claim 1 wherein the wristband is formed of material selected from the group consisting of natural and synthetic fiber canvas, natural and synthetic fiber duck, woven plastic fiber, nonwoven plastic sheet, and leather.

7. The article carrier according to claim 1 wherein the first and second fasteners are selected from the group consisting of zippers, snaps, buttons, buckles, and mating hook and loop fabric fasteners.

8. An article carrier, comprising:

a wristband having a proximal end, defined by an edge proximal to the user's elbow when the wristband is worn by a user, and a distal end, defined by an edge distal from a user's elbow when the wristband is worn by a user, opposite the proximal end;

a clasp attachment base permanently secured to the wristband, the base being a rigid block of material having a flat upper surface and a laterally concave undersurface adapted for generally conforming to a user's lower forearm and wrist;

a hinge pin disposed laterally through the clasp attachment base adjacent the distal end of the wristband; and a clasp having an attachment end pivotally attached to the hinge pin and a selectively openable end adjacent the proximal end of the wristband, the selectively openable end of the clasp being normally closed against the wristband.

9. The article carrier according to claim 8, wherein the wristband is formed of a thin, semi-rigid sheet of material, the distal end and the proximal end defining a length therebetween, the wristband further having a first closure edge and a second closure edge opposite the first closure edge, the wristband defining a diameter when the two closure edges are joined, the clasp having a length substantially equal to the length of the wristband and a width substantially equal to the diameter of the wristband, the article carrier further comprising mating first and second fasteners disposed along the respective first and second closure edges of the wristband.

10. The article carrier according to claim 9, further comprising mutually mating first and second closures disposed along the respective first and second closure edges of the wristband, the first and second closures being selected from the group consisting of zippers, snaps, buttons, buckles, and mating hook and loop fabric fastener.

11. The article carrier according to claim 8, wherein the wristband has an inner surface, the article carrier further comprising a liner disposed upon the inner surface of the wristband, the liner being formed of a sheet of soft and pliable material.

12. The article carrier according to claim 8, wherein the selectively openable end of the clasp has an upturned distal tip clear of the wristband, the clasp further having a raised medial portion clear of the wristband.

13. The article carrier according to claim 8 further comprising a mechanical latch disposed through the selectively openable end of the clasp, the latch selectively securing the selectively openable end of the clasp to the wristband.

14. The article carrier according to claim 8 wherein the wristband is formed of material selected from the group consisting of natural and synthetic fiber canvas, natural and synthetic fiber duck, woven plastic fiber, nonwoven plastic sheet, and leather.

15. An article carrier, comprising:

a wristband formed of a thin, semi-rigid sheet of material, the wristband having a distal end, defined by an edge distal from a user's elbow when the wristband is worn by a user, a proximal end, defined by an edge proximal to the user's elbow when the wristband is worn by a user, opposite the distal end, a first closure edge, a second closure edge opposite the first closure edge, and an inner surface;

a liner disposed upon the inner surface of the wristband, the liner being formed of a sheet of soft and pliable material; and a clasp having an attachment end permanently affixed to the wristband adjacent the distal end thereof and a selectively openable end adjacent the proximal end thereof, the selectively openable end of the clasp being normally closed against the wristband.

16. The article carrier according to claim 15, wherein:

the distal end and the proximal end of the wristband define a length therebetween;

the wristband defines a diameter when the two closure edges are joined;

the clasp has a length substantially equal to the length of the wristband and a width substantially equal to the diameter of the wristband; and the wristband further comprises mating first and second fasteners disposed along the respective first and second closure edges.

17. The article carrier according to claim 16, wherein:

the first and second fasteners are selected from the group consisting of zippers, snaps, buttons, buckles, and hook and loop fabric material; and the wristband is formed of material selected from the group consisting of natural and synthetic fiber canvas, natural and synthetic fiber duck, woven plastic fiber, nonwoven plastic sheet, and leather.

18. The article carrier according to claim 15, further comprising:

a clasp attachment base, the base being a rigid block of material having a laterally concave undersurface generally adapted for conforming to the contour of the user's lower forearm and wrist and having a flat upper surface;

a hinge pin disposed laterally through the clasp attachment base adjacent the distal end of the wristband, the attachment end of the clasp being pivotally attached to the hinge pin; and a coil spring disposed concentrically about the hinge pin, the coil spring urging the clasp to a closed position against the wristband.

19. The article carrier according to claim 15, wherein the selectively openable end of the clasp has an upturned distal tip clear of the wristband, the clasp further having a raised medial portion clear of the wristband.

20. The article carrier according to claim 15, further comprising a mechanical latch disposed through the selectively openable end of the clasp, the latch selectively securing the selectively openable end of the clasp to the wristband.

* * * * *